United States Patent [19]

Holzner, Sr.

[11] Patent Number: 4,930,667

[45] Date of Patent: Jun. 5, 1990

[54] BREATHING DEVICE FOR SOAP DISPENSER

[75] Inventor: Charles R. Holzner, Sr., Chicago, Ill.

[73] Assignee: Steiner Company, Inc., Chicago, Ill.

[21] Appl. No.: 299,934

[22] Filed: Jan. 23, 1989

[51] Int. Cl.[5] ..... B67D 5/58

[52] U.S. Cl. ..... 222/189; 222/207; 222/481; 222/494; 222/568

[58] Field of Search ..... 222/185, 189, 205, 213, 222/214, 209, 490, 494, 544, 481, 481.5, 207, 568

[56] References Cited

U.S. PATENT DOCUMENTS

| | | | |
|---|---|---|---|
| 3,149,758 | 9/1964 | Bush et al. | 222/189 |
| 4,130,224 | 12/1978 | Norman et al. | 222/214 X |
| 4,314,658 | 2/1982 | Laauwe | 222/481 X |
| 4,533,068 | 8/1985 | Meierhoefer | 222/213 X |
| 4,560,093 | 12/1985 | Cassia . | |
| 4,646,945 | 3/1987 | Steiner et al. | 222/213 X |
| 4,646,947 | 3/1987 | Stull | 222/520 X |
| 4,673,109 | 6/1987 | Cassia | 222/214 X |
| 4,776,495 | 10/1988 | Vignot | 222/213 X |
| 4,846,376 | 7/1989 | Palmer | 222/481 X |

FOREIGN PATENT DOCUMENTS

| | | | |
|---|---|---|---|
| 209223 | 1/1987 | European Pat. Off. | 222/214 |
| 1206034 | 2/1960 | France . | |
| 1399087 | 4/1965 | France . | |

*Primary Examiner*—Michael S. Huppert
*Assistant Examiner*—Gregory L. Huson
*Attorney, Agent, or Firm*—Emrich & Dithmar

[57] ABSTRACT

A liquid soap dispenser having an unvented liquid soap container with only an outlet opening, a discharge assembly in fluid communication with the soap container outlet opening, and a breathing mechanism including a semipermeable filter mounted between the discharge assembly and the soap container to introduce air into the soap container immediately upon withdrawal of soap from the container to permit rapid operation of the discharge assembly.

6 Claims, 1 Drawing Sheet

FIG. 1
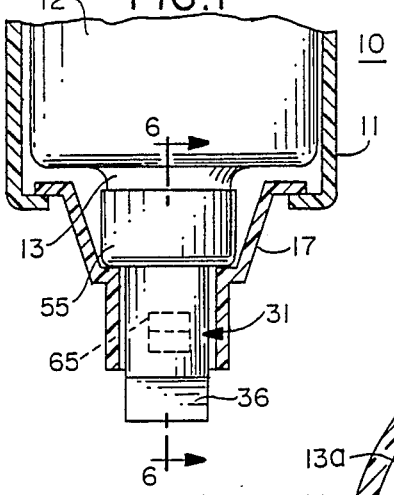
FIG. 5
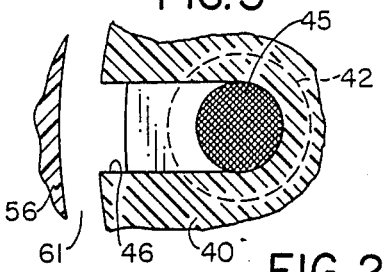
FIG. 2
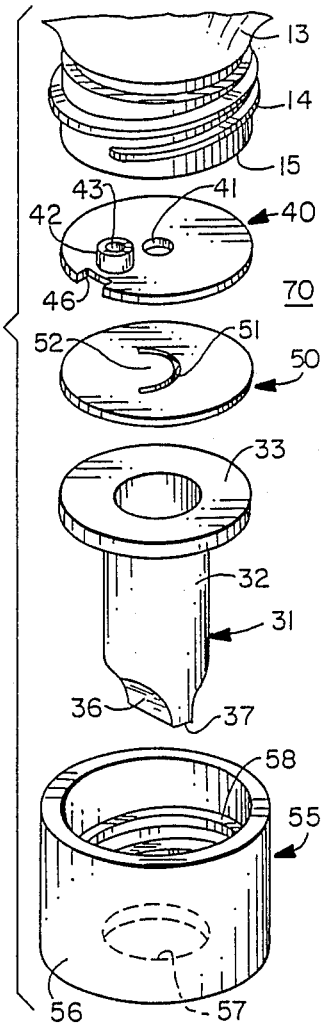
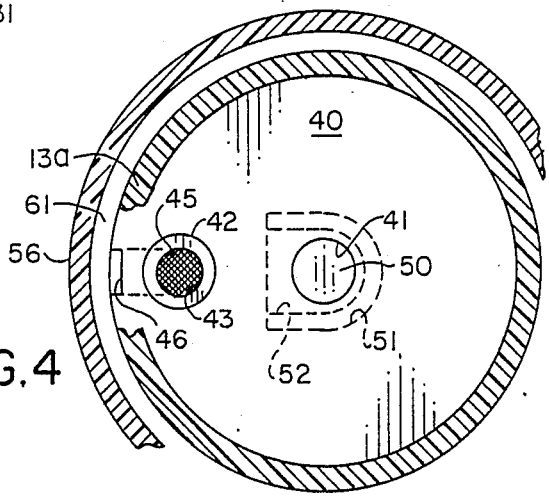
FIG. 4
FIG. 3
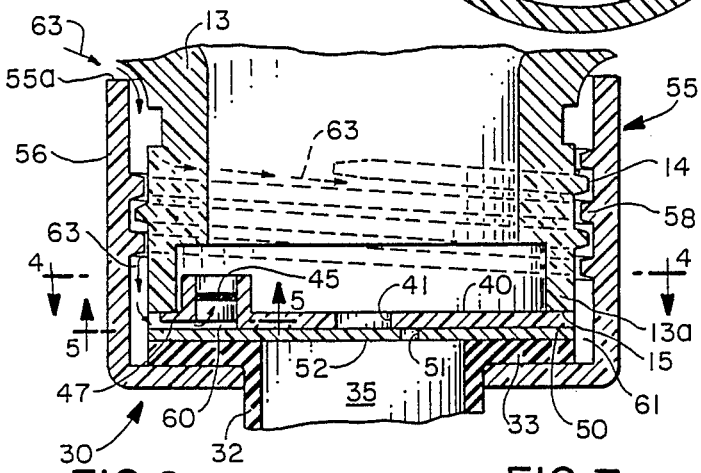
FIG. 6
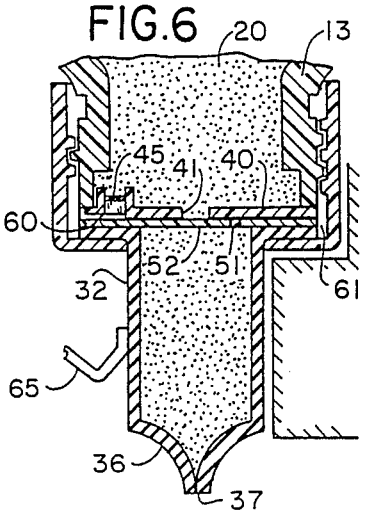
FIG. 7
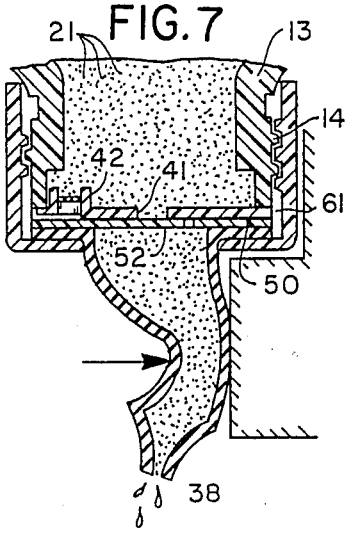
FIG. 8
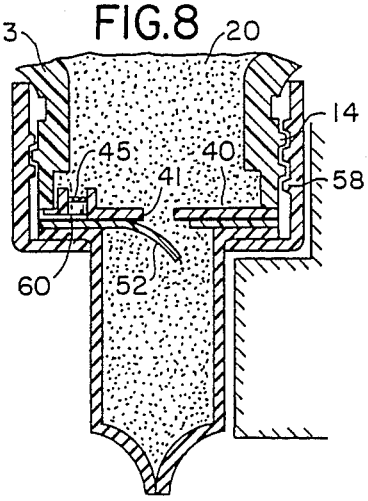

BREATHING DEVICE FOR SOAP DISPENSER

BACKGROUND OF THE INVENTION

The present invention relates to apparatus for dispensing liquid soap, normally in discrete small quantities or charges. The invention has particular application to the dispensing of liquid soap from replaceable cartridges which may contain grit for scouring purposes.

One type of soap dispenser is disclosed in U.S. Pat. No. 4,108,363 and includes a flexible pump bowl which receives soap from a container through a diaphragm-type check valve. When the bowl is compressed it closes the check valve and forces the soap in the bowl out through a passageway to a discharge outlet. This structure is relatively complex and is not well suited to modern distribution networks which require field maintenance by unskilled laborers, nor is it suited to the dispensing of soap containing grit, since the grit tends to clog the passageways in the device thereby increasing maintenance problems.

A similar type of dispenser using a compressible pump bowl or nipple is disclosed in U.S. Pat. No. 1,326,880, the dispenser ejecting soap directly from a slit in the pump nipple. This dispenser utilizes a custom-made check valve stopper in the soap container outlet, and depends on distortion of the slit in the nipple for dispensing of soap therefrom. Thus, the nipple is compressed in the direction of the slit. This has the disadvantage that the slit can be opened permitting soap to drip therefrom before pressure in the nipple has been raised sufficiently to close the check valve.

Another type of soap dispenser is disclosed in the Cassia EPC application Ser. No. 86300742.3, published Aug. 18, 1987, under publication no. 023 571, which includes mechanisms for dispensing discrete quantities of liquid soap. A problem which has been encountered in most of the prior art soap dispensing devices including those devices to Cassia is that repeated discharges of the dispensing mechanism of the soap results in less than full quantities of soap being discharged after the initial operation. Basically this is because there is insufficient air bleed to the soap container or cartridge so that refill into the discharge nozzle or nipple is not sufficient so that the prior art has not solved the problem of providing a full dosage when soap dispensers of the type referenced are subjected to repeated rapid uses, as is common in public washrooms and the like.

SUMMARY OF THE INVENTION

It is a general object of the invention to provide an improved discharge assembly for a liquid soap dispenser which avoids the disadvantages of prior devices while affording additional structural and operating advantages.

An important object of the invention is the provision of a discharge assembly for a liquid soap dispenser which is suitable for dispensing full discrete charges in rapid succession.

Another object of the invention is the provision of a discharge assembly of the type set forth, which is of simple and economical construction, and is characterized by ease of assembly.

Still another object of the invention is the provision of a discharge assembly of the type set forth which utilized an air bleed means of the type set forth to ensure full dosage for rapid repeat operation of the discharge assembly.

It is another object of the invention to provide a liquid soap dispenser which includes air bleed means in combination with a discharge assembly of the type set forth.

It is another object of the invention to provide a liquid soap dispenser comprising, an unvented liquid soap container having only an outlet opening, and a discharge assembly in fluid communication with said soap container outlet opening, breathing means including a semipermeable filter mounted between said discharge assembly and said soap container to introduce air into said soap container immediately upon withdrawal of soap from said container to permit rapid operation of said discharge assembly.

It is another object of the invention to provide a liquid soap dispenser including a liquid soap container having a neck defining an outlet opening and a discharge assembly comprising: an elongated flexible resilient nipple having a normal expanded condition defining a discharge chamber for accommodating a charge of liquid soap and having a longitudinal axis, the nipple having an inlet opening at one end thereof and being provided at the other end thereof with a normally closed discharge slit extending generally perpendicular to the axis, means mounting the nipple on the container with the inlet opening disposed in registry with the container outlet opening, check valve means including a flat membrane extending across the nipple opening and having a valve slit formed therein centrally thereof, a flat backing disc overlying the membrane and having an opening therein centrally thereof disposed in registry with the valve slit to permit liquid soap to flow therethrough and to prevent the membrane from being forced into the soap container, said flat backing disk having a notch in the periphery thereof, breathing means including a semipermeable filter in fluid communication with the notch in the disk establishing an air passage from outside to inside the soap container, and retaining means for retaining the nipple and the check valve and the backing disk in position on the soap container and providing an air passage from outside the soap container to the breathing means, the nipple being laterally compressible in a direction substantially perpendicular to the axis and to the discharge slit to a compressed condition, movement of the nipple to the compressed condition thereof raising the pressure in the discharge chamber for closing the check valve against the backing disk and ejecting liquid soap from the discharge slit, movement of the nipple back to the expanded condition thereof lowering the pressure in the discharge chamber for closing the discharge slit and opening the check valve to draw a new charge of liquid soap into the discharge chamber, passage of air through the breathing means rapidly reestablishing air pressure in the soap container permitting rapid refill and activation of the discharge means.

Another object of the invention is to provide a discharge assembly for a liquid soap dispenser including a liquid soap container having an outlet opening, the discharge assembly comprising: an elongated flexible resilient nipple having a normal expanded condition defining a discharge chamber for accommodating a charge of liquid soap and having a longitudinal axis, the nipple having an inlet opening at one end thereof and being provided at the other end thereof with a normally closed discharge slit, means mounting the nipple on the container with the inlet opening disposed in registry with the container outlet opening, check valve means disposed between the inlet opening and the container outlet opening, and breathing means including a semi-permeable filter establishing an air passage to the soap container, the nipple being laterally compressible in a direction substantially perpendicular to the axis, movement of the nipple to the compressed condition thereof raising the pressure in the discharge chamber for closing the check valve and ejecting liquid soap from the discharge slit, movement of the nipple back to the expanded condition thereof lowering the pressure in the discharge chamber for closing the discharge slit and opening the check valve to draw a new charge of liquid soap into the discharge chamber, passage of air through the breathing means rapidly reestablishing air pressure in the soap container permitting rapid refill of the discharge chamber with soap and rapid activation of the discharge means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

FIG. 1 is a fragmentary, sectional view of a liquid soap dispenser including a discharge assembly constructed in accordance with and embodying the features of the present invention;

FIG. 2 is an exploded view of the air bleed means and discharge assembly illustrated in FIG. 1;

FIG. 3 is an enlarged view in section of the distal end of the soap container and the retaining means connecting the soap container to the discharge assembly illustrating the air bleed path;

FIG. 4 is a view in section of the device illustrated in the FIG. 3 as seen along lines 4—4 thereof;

FIG. 5 is a view in section of the discharge assembly illustrated in FIG. 3 as seen along lines 5—5 thereof; and FIGS. 6–8 are enlarged fragmentary views in vertical section illustrating successive stages of soap discharge and recharge.

DESCRIPTION OF THE PREFERRED EMBODIMENT

Referring to the drawings, there is disclosed a liquid soap dispenser 10 including a dispenser housing schematically illustrated at 11 for positioning and retaining a soap container 12. The soap container 12 has a neck 13 which has at the distal end thereof a thin wall portion 13*a*. The neck portion 13 of the soap container 12 is externally threaded as at 14 and has an end surface 15, as seen in FIG. 3. A clip 17 maintains a discharge assembly 30 in position on the soap container 12, all as hereinafter set forth.

The soap container 12 has hand soap 20 or the like and is replaceable, as is well known in the art, and as illustrated in this invention, may contain grit 21 or other abrasive particles. The general soap dispenser 10 is similar to that disclosed in U.S. Pat. No. 4,018,363 and U.S. Ser. No. 902,099, filed Aug. 28, 1986, the disclosures of which are incorporated herein by reference. The discharge assembly 30 includes elongated, generally circular nipple 31 formed of a suitable flexible resilient material, such as rubber. The nipple 31 has a cylindrical side wall 32 provided at one end thereof with a radially outwardly extending flange 33. The nipple 31 defines a discharge chamber 35, see FIG. 3, and is provided at its distal end with a pair of radially inwardly sloping concave walls 36 which cooperate to form a flat, narrow duckbill-shaped tip 37 at the distal end of the nipple closing the discharge chamber 35. Formed in the tip 37 extending longitudinally thereof, substantially diametrically of the nipple 31, is an elongated discharge slit 38, which is normally held closed by the resilient biased nipple 31.

As shown in FIGS. 2–5, the valve assembly 70 includes a backing disc 40 and a valve diaphragm disc 50 which is maintained in registry with the nipple 31 by means of a retaining means 55. The backing disc 40 is a flat disc which may be of a suitable plastic material that is relatively stiff and has a central aperture 41 and an upstanding circular well 42, defining an opening 43 in which is placed a filter material 45. The filter material 45 may be any suitable material which permits air to pass therethrough but which does not permit soap to flow therethrough, such as a hydrophobic thermoplastic woven monofilament screen having openings in the range of from about 0.45 to about 10 microns. Representative thermoplastics are nylon, polyesters, polypropylene and teflon, polyurethane, ABS and the like, produce for instance by Filtertek, Inc. of Hebron, Illinois. The backing disc 40 also includes a notch 46 and the periphery thereof, as best seen in FIG. 2. The notch 46 is located in a portion of the disc 40 which also has a reduced thickness 47 as best seen in FIG. 3, the area 47 of reduced thickness extending from the periphery of the notch 46 to the inner end of the well 42, all for a purpose hereinafter explained. The diaphragm disc 50 includes a semicircular slit 51 in the disc 50 which defines a flap 52, the flap 52 being positioned so that the leading edge thereof lies under the backing disc 40, as best seen in FIGS. 3, and 6–8.

The retaining means 55 is a cylindrical collar 56 which has a central aperture 57 of a size through which the nipple 31 may pass and has internal threads 58 dimensioned loosely to engage the external threads 14 on the soap container neck 13. The retaining means 55 serves to maintain the nipple 31 in registered position with the backing disc 40 and the diaphragm disc 50, so as all to dispense measured quantities of soap 20 from the discharge assembly 30, as will be explained. When the backing disc 40 is assembled with the diaphragm disc 50, as best seen in FIG. 3, there is provided a space 60 between the disc 50 and the reduced portion 47 of the backing disc 40 which space 60 is in fluid communication with the annular channel 61 which is provided by the difference in dimensions between the retaining member 55 and the neck 13 of the soap container 12. An airpath is thereby established, as best seen by the arrows in FIG. 3, between outside the container 12 and the inside thereof, which air path flows between the neck 13 of the soap container 12 and the uppermost portion 55*a* of the cylindrical collar 56 through and along the threads 14 and 58 and thereafter through the space 60 and underneath the thin portion or reduced thickness portion 47 of the disc 40 and thereafter through the filter material 45 into the soap container 12.

In use, when the discharge assembly 30 has been assembled and mounted as described above, the valve assembly 70 is disposed for controlling the flow of liquid soap between the outlet opening of the container 12 and the inlet opening of the nipple 31. The generally cylindrical retaining clips 17 having the upper and lower flanges as illustrated cooperate with the dispenser housing 11 to maintain the configuration assembled. The clip 17 may be made out of a suitable flexible material so that it can be squeezed together to remove the soap container 12 from the bottom. There is also provided an actuator 65 which is shown schematically in the drawings and is carried by the housing 11 by suitable means, not shown. The actuator 65 projects through an opening in the retainer 17 for engagement with the outer surface of the nipple 31 as seen both in FIGS. 1 and 6.

Referring to FIGS. 6–8, the operation of the dispenser 10 and the discharge assembly 30 along with the means for continually introducing air into the soap container 12 will be explained. Preferably, the discharge assembly 30 is assembled on the container 12 when the neck 13 is disposed upwardly. Then, after assembly, the container 12 is inverted and mounted in the housing 11 as indicated in FIG. 1. With the nipple 31 projecting downwardly and through the bottom of the retainer clip 17.

While prior art soap containers may be vented or unvented, it is preferred for cleanliness as well as other reasons to use unvented soap containers 12. The problem encountered with unvented soap containers is in the rapid use of the discharge assembly 30 which results in a less than full dosage after the initial discharge or the initial two discharges. The reason for this phenomenon is the amount of time it takes for the pressure inside the container 12 to return to normal atmospheric pressure after a quantity of soap has been discharged which creates a vacuum. This problem of providing full dosage for each dispensing operation is obviated by the present invention wherein an air passage (see arrows 63 in FIG. 3) is established between the inside of the soap container 12 and the outside so as to continually provide full atmosphere pressure within the soap container irrespective of the number of discharge sequences.

With the continual feed of air into the soap container 12 the atmospheric pressure plus the weight of the liquid soap 20 on the diaphragm disc 50 and the flap 52 therein will allow liquid soap to flow through the opening 51 and through the opening 41 in the backing disc 40 into the discharge chamber 35 in the nipple 31. This flow will continue until the discharge chamber 35 is filled, at which time the pressure on the opposite sides of the disc 50 and particularly the flap 52 will be equalized, thereby allowing the flap 52 to close in an equilibrium condition, as illustrated in FIG. 6. The nipple 31 is so constructed that in this normal equilibrium condition, the natural resilient bias of the nipple 31 will hold the discharge slit 38 closed against the weight of the charge of liquid soap 20 contained in the discharge chamber 35.

When it is desired to dispense a charge of liquid soap, a user operates the actuator 65 for compressing the side of the nipple 31 in a direction of the narrow as seen in FIG. 7. The compression of cylindrical wall 32 of the nipple 31 raises the pressure in the discharge chamber 35, so that it holds the flap 52 of the diaphragm 50 closed and against the disc 40 to force the ejection of a charge of liquid soap from the chamber 35. Because the flap 52 is held against the disc 40 during the discharge operation, no change in the pressure in the soap container 12 occurs at this time. When the actuator 65 is released, it will return to its normal rest position under the urging of a suitable bias means (not shown), and the compressed wall of the nipple 31 will return to its normal expanded condition, see FIG. 8, as a result of the natural resilience of the nipple 31. This reexpansion of the nipple 31 will lower the pressure therein to a pressure below that in the container 12, so as to allow the discharge slit 38 of the nipple to reclose and to open the flap 52 in the diaphragm disc 50 as seen in FIG. 8. Hence, a new charge of liquid soap is drawn from the container 12 (thereby creating lower pressure in container 12) through the opening 41 and the backing disc 40 and the flap 52 and the diaphragm disc 50 into the discharge chamber 35 of the nipple 31. The rate of which the soap 20 flows into the nipple 31 and particularly the discharge chamber 35 is controlled to some extent by the pressure in the soap container 12. The pressure is equalized to normal atmospheric pressure by means of the air path established between the inside of the soap container 12 and the atmosphere, which path is shown by the arrows 63 in FIG. 3 and flows through the filter material 45 and the well 42. Particularly, the air flows downwardly as shown by the arrows 63 in FIG. 3 past the end 55*a* of the retaining means 55 through and around the threads and into the annular passageway or annular space 61 and hence beneath the disc 40 and into the well 42 and through the filter material 45 disposed therein. This mechanism permits air to flow into the soap container 12 while retaining the soap therein. This construction facilitates rapid discharge and charge of the discrete quantities of soap from the nipple 31 and is an improvement over the previous constructions heretofore mentioned.

In a model of the present invention, the nipple 31 is a unitary one-piece construction and may be formed by molding. The container 12 may be formed of a suitable plastic and may be blow molded where applicable. The retainer clip 17 and the actuator 65 may be formed of plastic or metal. In fact, the diaphragm disc may also be formed of plastic or metal depending on the circumstances of the case and the end use. It will be appreciated that the discharge assembly 30 can readily be assembled and mounted on the container 12 without the use of complicated tools and greatly facilitate the maintenance of this device in the field. The filter material 45 may be a non-woven polypropylene having a pore size of about 0.45 microns.

While there has been disclosed what is considered to be the preferred embodiment of the present invention, it is understood that various changes in the details may be made without departing from the spirit, or sacrificing any of the advantages of the present invention.

I claim:

1. A discharge assembly for a liquid soap dispenser including a liquid soap container having an outlet opening, said discharge assembly comprising an elongated flexible resilient nipple having a normal expanded condition defining a discharge chamber for accommodating a charge of liquid soap and having a longitudinal axis, said nipple having an inlet opening at one end thereof and being provided at the other end thereof with a normally closed discharge slit, means mounting said nipple on the container with said inlet opening disposed in registry with the container outlet opening, check valve means including a flat membrane extending across said inlet opening and having a valve slit formed therein centrally thereof disposed between said inlet opening and the container outlet opening, a flat backing disc overlying said membrane and having an opening therein centrally thereof disposed in registry with said valve slit, and breathing means carried on the back of said backing disc and including a well upstanding from said backing disc, a semipermeable material in said well permitting air to flow therethrough but impermeable to soap, said well being in fluid communication with said soap container and outside said soap container establishing an air passage to said soap container, said nipple being laterally compressible in a direction substantially perpendicular to said axis, movement of said nipple to the compressed condition thereof raising the pressure in said discharge chamber for closing said check valve and ejecting liquid soap from said discharge slit, movement of said nipple back to the expanded condition thereof lowering the pressure in said discharge chamber for closing said discharge slit and opening said check valve to draw a new charge of liquid soap into said discharge chamber, passage of air through said breathing means rapidly reestablishing air pressure in said soap container permitting rapid refill of said discharge chamber with soap and rapid activation of said discharge means.

2. The discharge assembly of claim 1, wherein said nipple includes a mounting portion extending therefrom adjacent to one end thereof for coupling to the soap container in surrounding relationship with the outlet opening.

3. The discharge assembly of claim 1, wherein said nipple is substantially circularly cylindrical in shape and said discharge slit extends diametrically of said nipple.

4. The discharge assembly of claim 3, wherein the distal end of said nipple is generally duckbill-shaped having sloping wall portions which coverage to a thin flat rectangular tip, said discharge slit being formed in said tip.

5. The discharge assembly of claim 1, wherein said soap container is threaded at the surface thereof near the outlet, a coupling mechanism having mating threads for loose engagement with said soap container threads trapping said breathing means in position between said inlet opening of nipple and the outlet of said soap container, said threads being constructed and arranged to permit the flow of air therealong.

6. The discharge assembly of claim 5, wherein said breathing means has a notch therein forming a fluid flow path with said coupling mechanism between the soap container and outside the soap container.

* * * * *